US011641959B2

(12) United States Patent
Daniels

(10) Patent No.: US 11,641,959 B2
(45) Date of Patent: May 9, 2023

(54) PILLOW WITH BAFFLES AND RELATED METHODS

(71) Applicant: ENCOMPASS GROUP, LLC., McDonough, GA (US)

(72) Inventor: Michelle Daniels, McDonough, GA (US)

(73) Assignee: ENCOMPASS GROUP, LLC., McDonough, GA (US)

( * ) Notice: Subject to any disclaimer, the term of this patent is extended or adjusted under 35 U.S.C. 154(b) by 0 days.

(21) Appl. No.: 17/448,535

(22) Filed: Sep. 23, 2021

(65) Prior Publication Data

US 2022/0053954 A1 Feb. 24, 2022

Related U.S. Application Data

(63) Continuation of application No. 16/697,628, filed on Nov. 27, 2019, now Pat. No. 11,154,148.

(60) Provisional application No. 62/775,536, filed on Dec. 5, 2018.

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 9/0253; A47G 9/109; A47G 9/1081; A47G 2009/1018; A47G 13/121; A47C 7/383
See application file for complete search history.

(56) References Cited

U.S. PATENT DOCUMENTS

| | | | | |
|---|---|---|---|---|
| 1,206,775 | A * | 11/1916 | Everts | A47G 9/10 5/645 |
| 2,589,303 | A * | 3/1952 | Sourbeck | A47G 9/10 5/645 |
| 3,426,372 | A | 2/1969 | Enelow | |
| 5,038,432 | A | 8/1991 | Robillard et al. | |
| 5,661,862 | A | 9/1997 | Ryndak | |
| 6,671,906 | B1 * | 1/2004 | Milligan | A47G 9/109 5/636 |
| 7,997,276 | B2 | 8/2011 | Goff | |

(Continued)

OTHER PUBLICATIONS

Hudson Medical Products "SleePAP CPAP Pillow with Pillowcase" https://www.cpap.com/productpage/SleePAP-cpap-pillow-with-pillowcase.html. Retrieved from internet Feb. 7, 2018 pp. 5. *** SeeU.S. Appl. No. 16/697,628.

(Continued)

*Primary Examiner* — David R Hare
*Assistant Examiner* — Alison N Labarge
(74) *Attorney, Agent, or Firm* — Allen, Dyer, Doppet + Gilchrist, PA

(57) ABSTRACT

A pillow may include a pillowcase having a first end, a second end opposing the first end, and first and second opposing sides extending between the first end and the second end. The pillowcase also may include first and second end chambers respectively adjacent the first and second ends, a medial chamber between the first and second end chambers, and baffles extending between the first and second opposing sides and defining the first and second end chambers and the medial chamber. The pillow also may include a pillow insert within one of the first and second end chambers, and the medial chamber.

20 Claims, 3 Drawing Sheets

(56) References Cited

U.S. PATENT DOCUMENTS

| | | | | |
|---|---|---|---|---|
| 9,138,084 | B1 * | 9/2015 | Namolovan | A47G 9/007 |
| 9,167,923 | B1 * | 10/2015 | Holbrook | A47G 9/10 |
| 2001/0003219 | A1 * | 6/2001 | Chou | A47G 9/0253 5/636 |
| 2003/0217412 | A1 * | 11/2003 | Johns | A47G 9/10 5/636 |
| 2006/0236460 | A1 | 10/2006 | Hooper | |
| 2008/0163428 | A1 | 7/2008 | Groteke et al. | |
| 2009/0139031 | A1 | 6/2009 | Davis et al. | |
| 2011/0056503 | A1 | 3/2011 | Abraham | |
| 2011/0179576 | A1 * | 7/2011 | Regan | A47G 9/10 5/645 |
| 2012/0073055 | A1 | 3/2012 | Cupo | |
| 2012/0073056 | A1 | 3/2012 | Freund et al. | |
| 2012/0180220 | A1 | 7/2012 | Popitz | |
| 2013/0091629 | A1 | 4/2013 | Eaton et al. | |
| 2013/0098364 | A1 | 4/2013 | Davis et al. | |
| 2013/0191998 | A1 | 8/2013 | Wootten, Jr. | |
| 2013/0232694 | A1 | 9/2013 | Ross et al. | |
| 2013/0245395 | A1 | 9/2013 | Bidarian Moniri | |
| 2015/0000042 | A1 | 1/2015 | Randall | |
| 2016/0106238 | A1 | 4/2016 | Vargas | |
| 2017/0099967 | A1 * | 4/2017 | Holbrook | A47G 9/10 |
| 2017/0172308 | A1 | 6/2017 | North | |
| 2019/0021526 | A1 * | 1/2019 | Deng | A47G 9/1081 |
| 2019/0254447 | A1 * | 8/2019 | Griggs | A47G 9/10 |
| 2020/0154912 | A1 | 5/2020 | Del Balso | |
| 2020/0323369 | A1 * | 10/2020 | Randall | A47G 9/109 |

OTHER PUBLICATIONS

Hudson Industries "Science of Sleep SleePAP CPAP Pillow" https://www.amazon.com/Science-Sleep-SleePAP-CPAP-Pillow/dp/B001FVRSFI ; Retrieved from internet Feb. 7, 2018; pp. 11 *** SeeU.S. Appl. No. 16/697,628.

* cited by examiner

PILLOW WITH BAFFLES AND RELATED METHODS

RELATED APPLICATION

This application is a continuation of application Ser. No. 16/697,628 filed on Nov. 27, 2019, which claims priority to prior filed Application No. 62/775,536 filed Dec. 5, 2018, the entire subject matter of these applications is incorporated herein by reference in its entirety.

TECHNICAL FIELD

The present disclosure relates to the field of bedding accessories, and, more particularly, to a pillow and related methods.

BACKGROUND

The bedding industry is a large and well developed industry in the U.S. Indeed, the U.S. industry alone boasts annual revenue over $15 billion. Nevertheless, the industry has undergone rapid disruption in last decade with the advent of online stores for mattresses and other bedding products.

One of the most common bedding products is the pillow. The pillow is not a modern creation and dates back to Mesopotamia and ancient Egypt. Nevertheless, the pillow has changed dramatically in the modern age. For example, pillows were once filled with natural pillow inserts, such as down and other plant based materials. Now, the modern pillow may be filled with hypoallergenic polymer foams.

A common condition that affects a user's sleep pattern is sleep apnea. One of the common treatments for sleep apnea is use of a continuous positive airway pressure (CPAP) machine. The CPAP machine is a positive airway pressure ventilator, which applies mild air pressure on a continuous basis to keep the airways continuously open in people. Typically, the CPAP machine comprises a powered base, a mask to be worn by the user, and one or more tubes coupled between the powered base and the mask.

SUMMARY

Generally, a pillow may include a pillowcase having a first end, a second end opposing the first end, and first and second opposing sides extending between the first end and the second end. The pillowcase may include first and second end chambers respectively adjacent the first and second ends, and a medial chamber between the first and second end chambers, and a plurality of baffles extending between the first and second opposing sides and defining the first and second end chambers and the medial chamber. The pillow may comprise at least one pillow insert within the first and second end chambers, and the medial chamber.

The plurality of baffles may each comprise a baffle piece, and baffle stitching along longitudinal sides of the baffle piece for coupling to adjacent portions of the pillowcase. The pillowcase may further comprise a plurality of dart stitches extending from a periphery of the pillowcase inwardly.

In some embodiments, the at least one pillow insert may comprise a plurality thereof respectively within the first and second end chambers, and the medial chamber. Each of the first and second ends, and the second opposing side may include a curved recess. Also, the first opposing side may comprise a closable opening. For example, the at least one pillow insert may comprise a foam material or a fiber material. Also, the pillowcase may be dog-bone shaped.

Another aspect is directed to a method for making a pillow. The method may include forming a pillowcase having a first end, a second end opposing the first end, and first and second opposing sides extending between the first end and the second end. The pillowcase may include first and second end chambers respectively adjacent the first and second ends, and a medial chamber between the first and second end chambers, and a plurality of baffles extending between the first and second opposing sides and defining the first and second end chambers and the medial chamber. The method may comprise positioning at least one pillow insert within the first and second end chambers, and the medial chamber.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Figure 1:
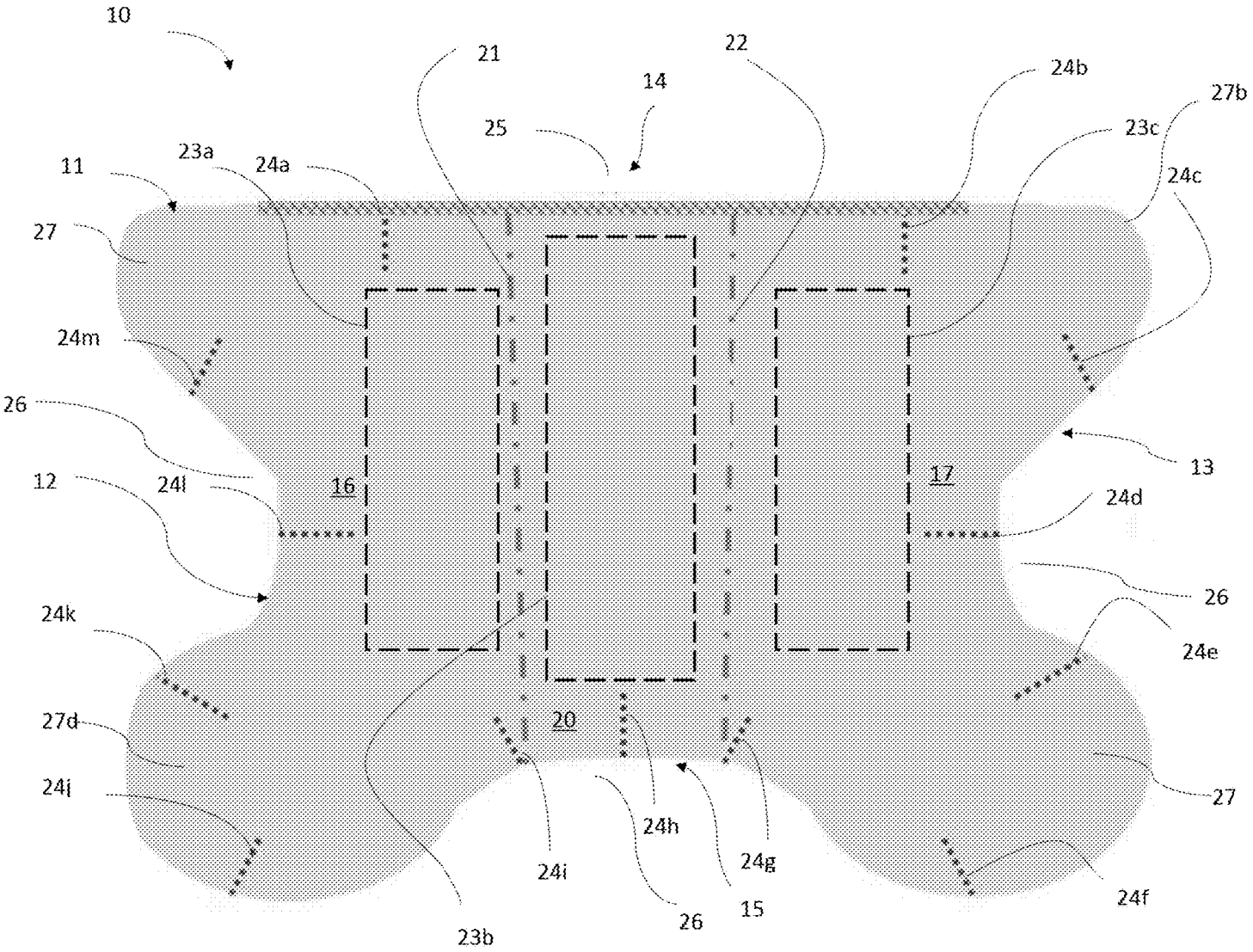
FIG. 1 is a schematic diagram of an example embodiment of a pillow, according to the present invention.
Figure 2:
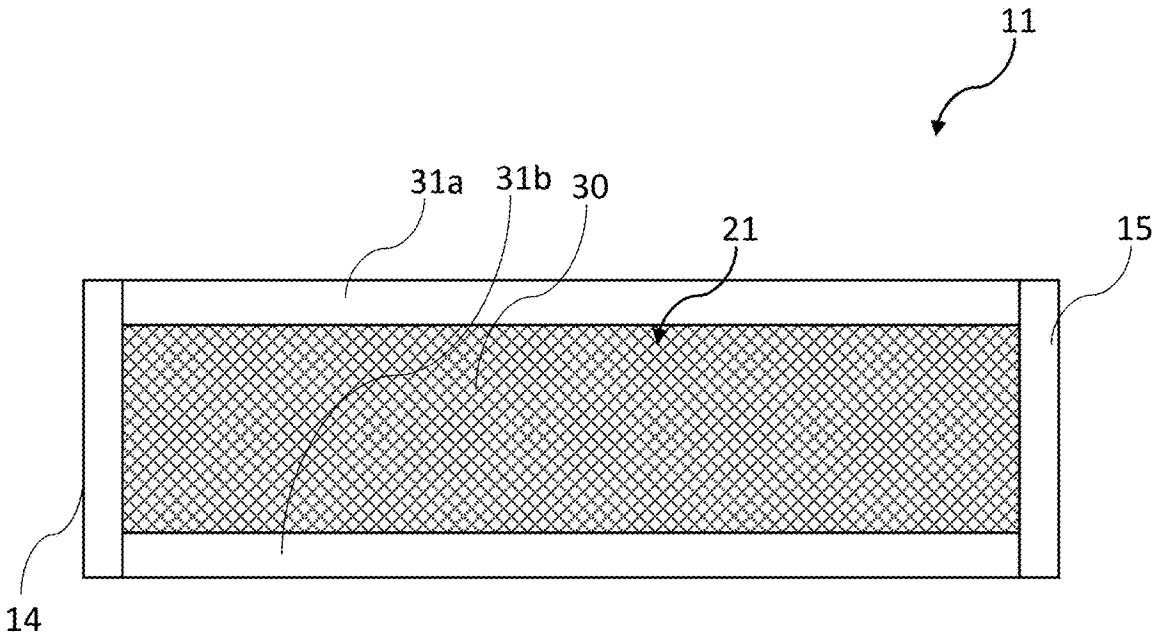
FIG. 2 is a schematic diagram of a baffle from the pillow of FIG. 1.

Referring initially to FIGS. 1-2, a pillow 10 according to the present disclosure is now described. The pillow 10 illustratively includes a pillowcase 11 having a first end 12, and a second end 13 opposing the first end. The pillow 10 illustratively includes first and second opposing sides 14-15 extending between the first end 12 and the second end 13. The pillowcase 11 may comprise a natural fabric material, such as cotton, or wool, or an artificial fabric material, such as a woven polymer material.

The pillowcase 11 illustratively comprises first and second end chambers 16-17 respectively adjacent the first and second ends 12-13, and a medial chamber 20 between the first and second end chambers. The pillowcase 11 also includes a plurality of baffles 21-22 extending between the first and second opposing sides 14-15 and defining barriers between the first and second end chambers 16-17 and the medial chamber 20.

As perhaps best seen in FIG. 2, the plurality of baffles 21-22 each comprises a baffle piece 30, and baffle stitching 31*a*-31*b* along longitudinal sides of the baffle piece for coupling to adjacent portions of the pillowcase 11. The baffle stitching 31*a*-31*b* may comprise mesh fabric sewn into adjacent opposing major surfaces of the pillowcase 11. Helpfully, this may aid in ventilation between the first and second end chambers 16-17, and the medial chamber 20.

In the illustrated embodiment, the baffle piece 30 extends completely between the first and second opposing sides 14-15 of the pillowcase 11. In other embodiments, the baffle piece 30 extends partially between the first and second opposing sides 14-15 of the pillowcase 11, defining gaps adjacent the first and second opposing sides 14-15 of the pillowcase 11. In other words, the gaps would flank the baffle piece 30, but in other embodiments, the baffle piece 30 defines a plurality of spaced apart slots or gaps therein.

In some embodiments, the pillow 10 also includes a pillow insert 23*b* only within the medial chamber 20. In the illustrated embodiment, the pillow 10 also additionally includes respective pillow inserts 23*a*, 23*c* for each of the first and second end chambers 16-17 (i.e. all three chambers 16-17, 20 receive a pillow insert). Each of the pillow inserts 23*a*-23*c* may comprise a polymer foam insert, or a fiber material insert (e.g. synthetic or natural). In some embodiments, each of the pillow inserts 23*a*-23*c* may comprise a blown fill material, for example, a synthetic fiber fill material.

Each of the first and second ends 12-13, and the second opposing side 15 includes a curved recess 26*a*-26*c*. Also, the first opposing side 14 illustratively comprises a closable opening 25 extending across all three chambers 16-17, 20. For example, the closable opening 25 may comprise a zipper, a plurality of buttons and respective opposing slits, or a hook and loop fastener. The closable opening 25 is configured to permit access to the first and second end chambers 16-17, and the medial chamber 20. In some embodiments, the pillowcase 11 may comprise individual closable openings for each of the first and second end chambers 16-17, and the medial chamber 20. In other embodiments (single pillow insert embodiments), the pillowcase 11 may comprise a single zipper permitting access to only the medial chamber 20.

In the illustrated example, the pillowcase 11 is dog-bone shaped. In particular, the first opposing side 14 is straight. The first end 12 comprises first and second lateral protrusions 27*a*, 27*d* with the curved recess 26*a* therebetween. The second end 13 also comprises first and second lateral protrusions 27*b*, 27*c* with the curved recess 26*b* therebetween. In the illustrated embodiment, each of the bottom lateral protrusions 27*c*-27*d* is substantially circular in shape. Each of the top lateral protrusions 27*a*-27*b* comprises a first portion extending directly from the first opposing side 14 at a canted angle of approximately 10° (i.e. ±7°), a second portion extending directly from the first portion and having a curved edge, and a third portion extending directly from the second portion and being substantially straight (i.e. ±7° of straight plumb). The third portion merges into a medial curved edge for defining the curved recesses 26*a*-26*b*. Advantageously, this shape is conducive to the use of a CPAP machine.

Also, the pillowcase 11 illustratively comprises a plurality of dart stitches 24*a*-24*m* extending from a periphery of the pillowcase inwardly. In particular, each of the plurality of dart stitches 24*a*-24*m* extends inwardly at a substantially perpendicular angle (i.e. 90°±10°) from the peripheral edge, and a linear length of substantially 10% (i.e. ±5%) of the length between the first and second opposing sides 14-15. The plurality of dart stitches 24*a*-24*m* are helpful in maintaining the position of the pillow inserts 23*a*-23*c*.

Figure 3:
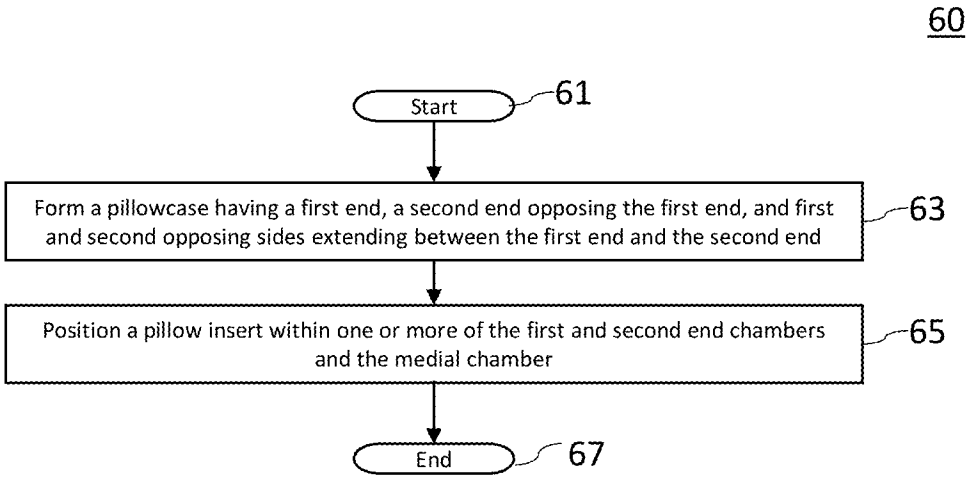
FIG. 3 is a flowchart illustrating a method for making the pillow of FIG. 1.

Referring now additionally to FIG. 3, another aspect directed to a method for making the pillow 10 is now described with reference to a flowchart 60. The method includes forming a pillowcase 11 having a first end 12, a second end 13 opposing the first end, and first and second opposing sides 14-15 extending between the first end and the second end. (Blocks 61, 63). The pillowcase 11 also includes first and second end chambers 16-17 respectively adjacent the first and second ends 12-13, a medial chamber 20 between the first and second end chambers, and a plurality of baffles 21-22 extending between the first and second opposing sides 14-15 and defining the first and second end chambers and the medial chamber. The method also comprises positioning at least one pillow insert 23*a*-23*c* within the medial chamber 20. (Blocks 65, 67).

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A pillow comprising:
- a pillowcase having a first end, a second end opposing the first end, and first and second opposing sides extending between the first end and the second end;
- the pillowcase comprising
  - first and second end chambers respectively adjacent the first and second ends, and
  - a medial chamber between the first and second end chambers, and
  - a plurality of baffles extending completely between the first and second opposing sides and defining the first and second end chambers and the medial chamber, each baffle comprising
    - a baffle piece, and
    - a mesh material stitched along longitudinal sides of the baffle piece for coupling to adjacent portions of the pillowcase; and
- at least one pillow insert within the first and second end chambers, and the medial chamber.

2. The pillow of claim 1 wherein the pillowcase comprises a plurality of stitches extending inwardly from a periphery of the pillowcase, the plurality of stitches maintaining a position of the at least one pillow insert.

3. The pillow of claim 2 wherein each of the plurality of stitches extends inwardly at a substantially perpendicular angle from the periphery of the pillowcase.

4. The pillow of claim 1 wherein the at least one pillow insert comprises a plurality thereof respectively within the first and second end chambers, and the medial chamber.

5. The pillow of claim 1 wherein each of the first and second ends, and the second opposing side includes a curved recess.

6. The pillow of claim 1 wherein the first opposing side comprises a closable opening.

7. The pillow of claim 1 wherein the at least one pillow insert comprises a foam material.

8. The pillow of claim 1 wherein the at least one pillow insert comprises a fiber material.

9. The pillow of claim 1 wherein the pillowcase is dog-bone shaped.

10. A pillowcase comprising:
- a first end;
- a second end opposing the first end;
- first and second opposing sides extending between the first end and the second end;
- first and second end chambers respectively adjacent the first and second ends;
- a medial chamber between the first and second end chambers; and
- a plurality of baffles extending completely between the first and second opposing sides and defining the first and second end chambers and the medial chamber, each baffle comprising a baffle piece, and a mesh material stitched along longitudinal sides of the baffle piece for coupling to adjacent portions of the pillowcase;

wherein at least one pillow insert is to be positioned within the first and second end chambers, and the medial chamber.

11. The pillowcase of claim 10 further comprising a plurality of stitches extending inwardly from a periphery of the pillowcase, the plurality of stitches maintaining a position of the at least one pillow insert.

12. The pillowcase of claim 11 wherein each of the plurality of stitches extends inwardly at a substantially perpendicular angle from the periphery of the pillowcase.

13. The pillowcase of claim 10 wherein each of the first and second ends, and the second opposing side includes a curved recess.

14. The pillowcase of claim 10 wherein the first opposing side comprises a closable opening.

15. The pillowcase of claim 10 wherein the at least one pillow insert comprises one of a foam material and a fiber material.

16. A method for making a pillow comprising:

forming a pillowcase having a first end, a second end opposing the first end, and first and second opposing sides extending between the first end and the second end;

the pillowcase comprising first and second end chambers respectively adjacent the first and second ends, a medial chamber between the first and second end chambers, and a plurality of baffles extending completely between the first and second opposing sides and defining the first and second end chambers and the medial chamber, each baffle comprising a baffle piece, and a mesh material stitched along longitudinal sides of the baffle piece for coupling to adjacent portions of the pillowcase; and positioning at least one pillow insert within the first and second end chambers, and the medial chamber.

17. The method of claim 16 wherein the pillowcase comprises a plurality of stitches extending inwardly from a periphery of the pillowcase, the plurality of stitches maintaining a position of the at least one pillow insert.

18. The method of claim 17 wherein each of the plurality of stitches extends inwardly at a substantially perpendicular angle from the periphery of the pillowcase.

19. The method of claim 16 wherein the at least one pillow insert comprises a plurality thereof respectively within the first and second end chambers, and the medial chamber.

20. The method of claim 16 wherein each of the first and second ends, and the second opposing side includes a curved recess.

* * * * *